US006884095B1

(12) United States Patent
Tsai

(10) Patent No.: US 6,884,095 B1
(45) Date of Patent: Apr. 26, 2005

(54) ADAPTOR BOX FOR MOUNTING FIXTURE TO LOW VOLTAGE TRACK

(75) Inventor: Meng-Feng Tsai, Bethpage, NY (US)

(73) Assignee: W.A.C. Lighting, Garden City, NY (US)

( * ) Notice: Subject to any disclaimer, the term of this patent is extended or adjusted under 35 U.S.C. 154(b) by 0 days.

(21) Appl. No.: 10/784,150

(22) Filed: Feb. 20, 2004

(51) Int. Cl.[7] ..... H01R 25/00
(52) U.S. Cl. ..... 439/121; 439/118
(58) Field of Search ..... 439/124, 121–123, 439/118–120, 110, 116–117, 884; 362/226, 287

(56) References Cited

U.S. PATENT DOCUMENTS

| | | | | | |
|---|---|---|---|---|---|
| 4,108,523 | A | | 8/1978 | Bolis | 439/116 |
| 4,699,439 | A | | 10/1987 | Cohen | 439/207 |
| 4,919,625 | A | | 4/1990 | Coutre | 439/118 |
| 5,128,847 | A | * | 7/1992 | Lin et al. | 362/226 |
| 5,334,037 | A | | 8/1994 | Gabrius. | 439/118 |
| 5,603,622 | A | * | 2/1997 | Lin | 439/121 |
| 6,059,582 | A | | 5/2000 | Tsai | 439/121 |
| 6,203,339 | B1 | * | 3/2001 | Nieminen | 439/118 |
| 6,450,826 | B1 | * | 9/2002 | Howell et al. | 439/342 |
| 6,634,895 | B1 | * | 10/2003 | Agro | 439/121 |
| 2002/0064979 | A1 | * | 5/2002 | Zakerzewski | 439/110 |
| 2003/0223234 | A1 | * | 12/2003 | Tang | 362/226 |

* cited by examiner

*Primary Examiner*—Michael C. Zarroli
(74) *Attorney, Agent, or Firm*—Robert W. J. Usher

(57) ABSTRACT

An adaptor box for mounting a fixture to a low voltage track having a housing containing contacts with one of their ends formed with female contact portions which are arranged on above the other in the housing to provide a common mating axis in the housing connection to a male coax connector of the fixture and other ends forming feet protruding from a mounting head of the housing for connection to respective busses of the low voltage track. Contact separating and locating protuberances are molded on the interior of the housing and an insert molded with additional contact locating and separating protuberances is assembled through a front opening in the housing.

11 Claims, 4 Drawing Sheets

ADAPTOR BOX FOR MOUNTING FIXTURE TO LOW VOLTAGE TRACK

FIELD OF THE INVENTION

The invention relates to an adaptor box for mounting a low voltage lighting fixture equipped with a coaxial plug connector to a low voltage track.

BACKGROUND OF THE INVENTION

Adaptor boxes are used for mounting low voltage lighting fixtures to a low voltage track. As well recognized, such adaptor boxes must not only provide reliable mechanical support for the lighting fixture but also reliable electrical connection. As such fixtures typically operate on only 12 volts, even a small voltage drop at the connection to the track may result in a discernable effect on the operation of the light fixture.

At the same time the adaptor boxes should be of desirably small size with few parts, affording economic manufacture and assembly at high volume.

U.S. Pat. No. 6,059,582 issued May 9, 2000 to the present inventor Tsai, the disclosure of which is incorporated herein by reference, teaches a commercially successful adaptor box for mounting a fixture to a conventional low voltage lighting track comprising an insulating body formed by an elongate web joining flanges, having respective free ends from which mounting edge portions protrude inwards towards each other over the elongate web defining a channel section cavity for receiving a mounting head portion of the adapter box, ears located adjacent junctions of the flanges and the web and wire busses mounted on respective ears.

The adaptor box comprises a housing molded in one piece of insulating plastic material and comprising opposite side walls joined by upper, lower and rear walls providing a housing cavity having a front which is open, a mounting head integrally formed with the upper wall to upstand therefrom and formed with opposed mounting ears and a contact receiving through-passageway having a front, contact insertion opening, both the contact receiving through-passageway and the front, contact insertion opening extend from the housing cavity vertically through the mounting head between the mounting ears, the upper wall being formed with a recess extending from the front of the housing cavity which is open to the front, contact insertion opening so that the housing is open at a front and at a top, from the front to the front, contact insertion opening; an opening in the lower wall; an insert molded in one piece of insulating plastic material comprising a contact separating rib and a releasable, rotation preventing latching tab portion connected together to extend in generally parallel relation, one above the other, by a transverse, resilient web hinge; a pair of contacts extending through the contact receiving through-passageway each having one end for connection to respective conductors of a fixture and another end exposed for electrical connection to respective track busses; means for attaching a low voltage lighting fixture to the housing, and the housing and the insert having resilient latching means cooperable to assemble the housing and insert together in a snap fit; the insert being assembled with the housing by insertion of the contact separating rib through the front, contact insertion opening into the through-passageway, between the contacts, with the rotation preventing latching tab portion extending across the front of the housing cavity and the transverse, resilient web hinge extending across the recess, the rotation preventing latching tab comprising an upper catch portion which, in an undeformed position of the resilient web hinge, protrudes above the upper wall of the housing in a rotation preventing position preventing rotation of the housing relative to the channel section cavity of the track when the mounting head is received therein and a lower fingerpiece, depressible to deform the resilient web hinge and withdraw the upper catch portion toward the upper wall to a release position permitting rotation of the mounting head within the channel section cavity of the track to enable removal of the adaptor box therefrom.

In the adaptor box described above, the contacts are terminated to respective wires of a fixture by soldering or crimping thereto, establishing permanent connections with the fixture wires, and the contacts and wires subsequently threaded into the adaptor housing and positioned accurately in the contact receiving passageway of the mounting head and the insert subsequently assembled with the housing. The assembled adaptor box can then be mounted to the low voltage track.

A disadvantage of such arrangement is that changing the fixture requires disassembly of the adaptor box demounted from the track. The need to assemble and disassemble the adaptor box demounted from the track prevent a fixture being mounted to the track as rapidly as may be desired in some circumstances.

SUMMARY OF THE INVENTION

It is an object of the invention to provide an adaptor box of the type mentioned above but which permits a fixture to be quicky and easy connected and disconnection of a fixture thereto and, preferably, irrespective of whether the adaptor box is mounted on a low voltage track.

According to the invention in an adaptor box of the type described above, the improvement resides in that said one ends of the contacts comprise, respectively, a first, resilient female contact portion and a second, resilient female contact portion, means are provided in the housing cavity for locating the contacts with the first female contact portion aligned spaced apart from and above the second female contact portion to provide a common mating axis aligned with the opening in the lower wall, so that a male coax connector having a first male contact portion and a second male contact portion, located axially spaced apart from each other, adjacent and remote from a leading free end, respectively, can be inserted through the opening in the lower wall progressively into the housing cavity along the mating axis so that the first male contact portion passes through the second female contact portion and mates with the first female contact portion and the second male contact portion mates with the second female contact portion.

This enable a fitting with a coax connector to be quickly connected to and disconnected from the adaptor box by a simple plugging and unplugging action without need for subsequent or prior assembly and disassembly of the adaptor box which also need not be demounted from the low voltage track.

Preferably, each contact is stamped and formed from a single piece of sheet metal stock and each second female contact portion is joined to the other end of a respective contact by a strip portion and comprises a pair of resilient contact arms extending transversely in opposed, spaced apart relation from the strip portion on opposite sides of the opening in the lower wall so as to embrace the male coax connector when inserted into the housing cavity.

In a more specific construction, the first female contact portion is joined to the other end of a respective contact by another strip portion and the first female contact portion comprises a pair of resilient contact arms extending transversely in opposed, spaced apart relation from said another strip portion so that the arms embrace the male coax connector inserted into the housing cavity, the strip portion from which the first female contact portion extends and the strip portion from which the second female contact portion extends being vertical and respectively, located adjacent respective opposite sidewalls of the housing cavity so that the resilient contact arms of the first female contact portion extend across the housing cavity in a direction opposite to a direction of extension of the resilient contact arms of the second contact portion and, the strip portion from which the first female contact portion extends being shorter than the strip portion from which the second female contact portion extends. The strip portions of respective contacts are bent as they exit from the contact receiving through-passageway into the housing cavity to define divergent transverse portions extending adjacent the upper wall, respectively, away from each other towards opposite sidewalls, and above the first female contact, portion, to join the respective vertical strip portions.

It is further preferred that the means in the housing cavity for locating the first female contact portion aligned spaced apart from and above the second female contact portion to provide a common mating axis comprises a contact separating post protruding horizontally forward from the rear wall and laterally offset from one side of the common mating axis, to extend between respective female contacts to maintain their vertical separation and, a one-piece, insulating, contact locating insert comprising a vertical frame received through the open front into the housing cavity as a sliding fit and having a contact separating post projecting horizontally rearward and laterally offset from a side of the common mating axis opposite to the post on the rear wall of the housing cavity, to extend between respective female contacts to maintain their vertical separation.

Thus the function of contact location and separation is shared between the housing and the insert added subsequently to contact assembly, the absence of the insert permitting initial contact assembly through the front opening and providing more clearance to assemble the contacts in the housing and a simpler housing mold.

The contact locating insert preferably comprises adjoining, orthogonal wall portions extending rearward, horizontally and vertically, from upper, horizontal and vertical side members of the frame between the transverse and vertical strip portions of one contact and the resilient contact arms of the second female contact portion to maintain the contacts electrically isolated from each other.

Conveniently, the contact separating post on the insert is integrally molded as a rib with a lower edge of the vertical wall portion which extends from the vertical side member. This provides a desirable strong/robust structure in what is a small molded, plastic part.

Desirably, the means for attaching a low voltage lighting fixture to the housing, comprises a threaded annular lip integrally molded with the lower wall to depend from the housing around the opening. This enables the coax connector of the fixture to be simply screwed onto the lip to mechanically attach the fixture to the adaptor box, while the screwing action progressively and controllably advances the male contacts along the mating axis into the adaptor box to minimize risk of misalignment and dislocation/distortion of contacts.

According to another aspect, the invention provides an adaptor box for mounting a fixture to a low voltage lighting track comprising:

an insulating housing having a cavity open at a bottom, an upstanding track mounting head formed with opposed mounting ears, a pair of one-piece contacts extending through the track mounting head into the cavity each contact having one end for connection in the cavity to a low voltage lighting fixture and another end protruding exposed from the track mounting head for electrical connection to respective track busses, and, means on the housing for attaching a low voltage lighting fixture to the housing, the improvement residing in that the one ends of the contacts comprise, respectively, a first, resilient female contact portion and a second, resilient female contact portion, means are provided in the housing cavity for locating the contacts with the first female contact portion aligned spaced apart from and above the second female contact portion to provide a common mating axis aligned with the opening, so that a male coax connector having a first male contact portion and a second male contact portion, located axially spaced apart from each other, adjacent and remote from a leading free end, respectively, can be inserted through the opening progressively into the housing cavity along the mating axis so that the first male contact portion passes through the second female contact portion and mates with the first female contact portion and the second male contact portion mates with the second female contact portion.

The invention also provides an electrical contact set for an adaptor box for mounting a low voltage lighting fixture to a low voltage track comprising a pair of one-piece stamped and formed metal parts each having a rigid elongate strip portion formed at one longitudinal end with a female contact portion and at the other end with a transverse contact foot for engagement with a respective buss of a low voltage track, the female contact portions each comprise a pair of resilient contact arms bent from opposite longitudinal edges of the strip to extend transversely from the strip in opposed, spaced apart parallel relation for embracing a male contact between them, the strip of one contact being shorter, longitudinally, than the strip of the other contact so that the contacts can be mounted in a housing with the female contact portions extending one above on a common vertical mating axis while the transverse contact extend horizontally, coplanar with each other.

BRIEF INTRODUCTION TO THE DRAWINGS

In order that the invention may be readily understood, a specific embodiment thereof will now be described with reference to the accompanying drawings in which:

FIGS. 1*a–d* are isometric views of an adaptor box according to the invention showing the components thereof at successive stages of assembly;

DESCRIPTION OF PARTICULAR EMBODIMENT

Figures 1A, 1B, 1C, 1D:
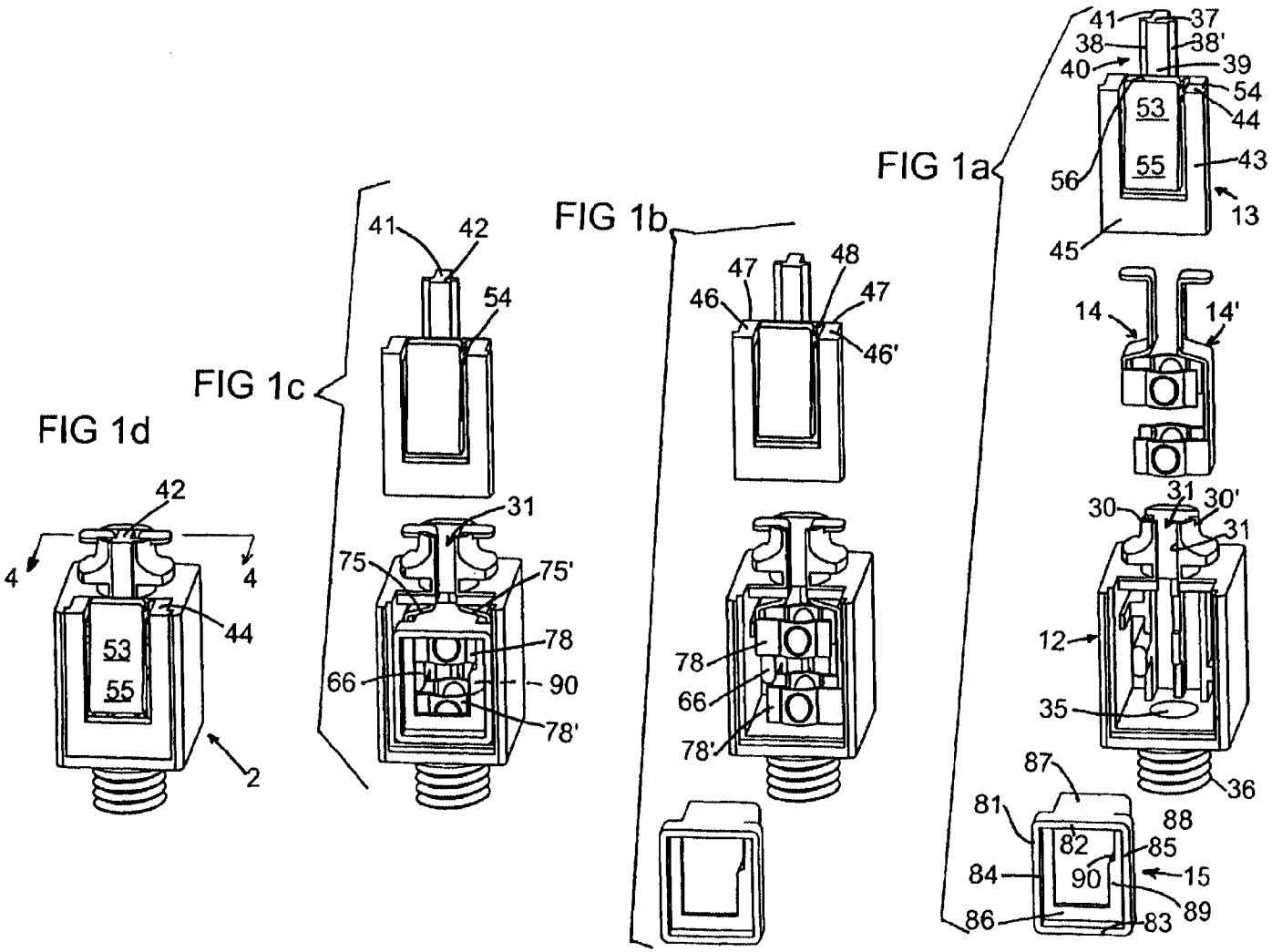

The adaptor box 2 comprises a housing 12 receiving an insert 13 forming a combined contact separator and anti-rotation member, a pair of electrical contacts 14, 14' and, a contact locating insert 15. In external construction and dimension the adaptor box housing 12 and insert 13 are generally similar to those disclosed in U.S. Pat. No. 6,059,582 referred to above.

Figure 2:
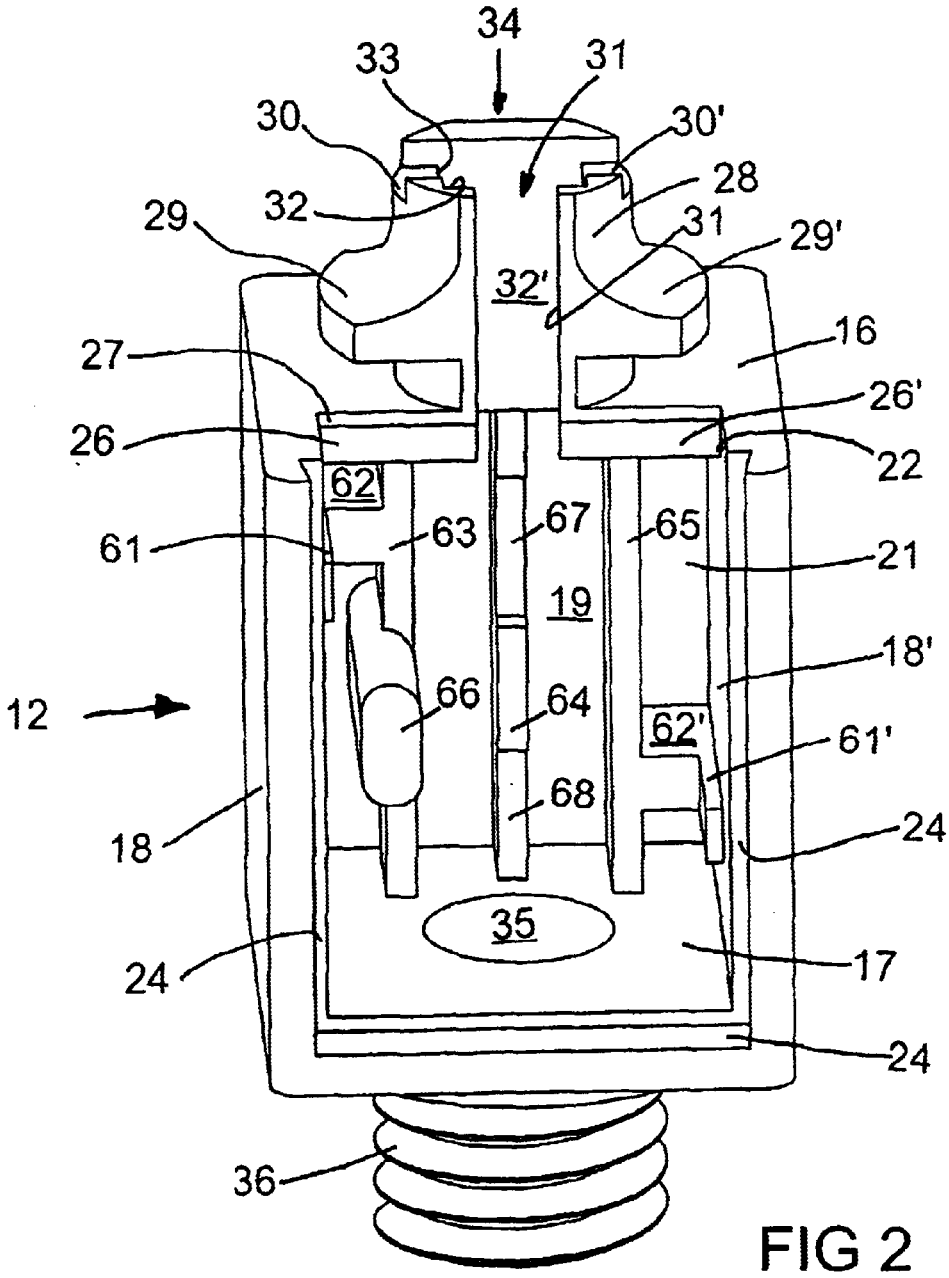
FIG. 2 is an isometric view of the front of the housing of the adaptor box at a greater scale.

As best seen in FIG. 2, the housing 12 is injection molded in one piece from suitable insulating plastic material as a hollow rectanguloid body having upper and lower walls 16, 17, respectively; opposite side walls 18, 18' and a rear wall 19. The housing has a front opening 21 which is continuous with a rebate 22 which extends rearwardly in the upper wall 16 for approximately one third the front to rear depth thereof providing access to the interior.

Forward edge portions of the lower and opposite side walls 17 and 18, 18', respectively, are of reduced thickness or stepped around the front opening to provide an insert locating recess or seat 24 which extends to the upper face. The upper wall 16 has a front edge undercut to form a latching recess 26 with a latching lip 27.

A track mounting head 28 upstands from a forward portion of the upper wall 16, centrally of the box, and is formed with a pair of opposed, track mounting ears 29, 29', protruding from opposite sides thereof. Upwardly opening, contact receiving recesses 30, 30' are formed on opposite sides of the top of the head aligned centrally above respective ears. The mounting head is formed with a central, vertically extending contact receiving passageway 31 of generally rectangular cross-section having front, rear and opposite side walls, 32, 32' and 33, respectively, with a contact insertion slot 34 extending axially vertically in the front wall 31 for the entire height thereof.

The bottom wall 17 is formed, at a central location, with a wire receiving opening 35 surrounded by a threaded tubular lip 36 which depends from a lower face.

The walls of the housing cavity are molded with a series of contact locating ribs for locating the contacts with female contact portions thereof (described below) aligned with the opening 35 and spaced apart from each other. In particular, upper and lower ribs 61, 61' extend front to rear, on opposite sidewalls 18, 18' for locating contacts 14, 14', respectively, and join upper and lower horizontal ribs 62, 62' respectively, molded on the rear wall 19. A series of three vertical ribs 63, 64 and 65 are molded on the rear wall, rib 63 joining rib 62 and rib 65 joining rib 62'. A contact separating post 66 protrudes horizontally forward from a location towards the left side and half way up the rear wall and merges partly at a root end with the vertical rib 63. The central rib 64 is formed with upper and lower recesses 67 and 68, respectively, providing seats for the respective female contact portions of the contacts.

The insert 13 is injection molded in one piece from the same plastic material as the housing and comprises a contact separating rib portion 37 of T cross-section having opposed, locating flanges or arms 38, 38' extending from respective opposite sides of a stem 39 so as to define a forward head portion 40 from which extends a body portion 41 which tapers adjacent a top. A partitioning tab of reduced thickness extends centrally from a lower end of the rib 37.

The anti-rotation portion 43 comprises a right angled, locating frame-like portion having upper and lower U-form sub frame portions 44 and 45, respectively, comprising respective pairs of parallel arms joined by respective transverse arms. A latching tab 53 is mounted by a loop-section resilient web hinge 54 so as to lie within the lower sub frame 45 in general coplanar relation therewith and progressively increases in thickness toward a lower portion forming a button or fingerpiece 55 which, in a normal, undeformed position of the hinge 54, protrudes forwards out of the plane of the front of the lower sub frame 45, and an uppermost catch portion 56 which protrudes upwards out of the plane of the top of the upper sub frame 44. Additional constructional details of the insert 13 are found in U.S. Pat. No. 6,059,582. A difference is that very small latching detents 47 with lead in ramp surfaces ramps for engagement in recesses 26, 26' are formed on rear upper edges of cross arm 48 instead of on opposed arms 46, 46' of sub frame 45 in the prior version.

Figure 3:
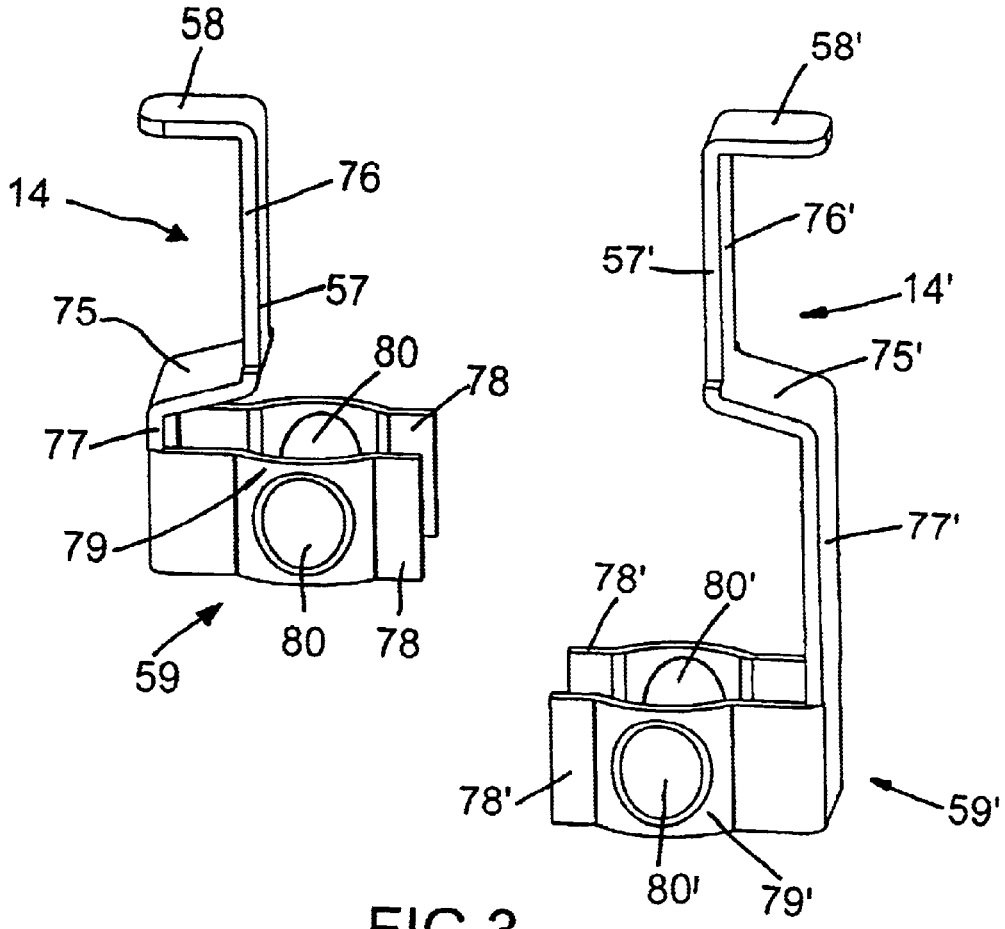
FIG. 3 is an isometric view of the contacts of the adaptor box.

As shown in FIG. 3, the contacts 14, 14' are stamped and formed metal parts each comprising a rigid leaf portion 57, 57' formed at one free end with a female contact portion 59, 59' and at the other end with a transverse contact foot 58, 58'. The leaf portions each comprise a transverse portion 75, 75' joining upper and lower vertical portions 76, 76' and 77, 77'. The sole difference between the contact is that the lower vertical portion 77' of contact 14' is longer than the corresponding portion 77 of the contact 14. The female contact portions each comprise a pair of resilient contact arms 78, 78' bent from opposite edges of the lower vertical portion 77 or 77' to extend transversely in opposed, spaced apart parallel relation for embracing a male contact between them. Each arm has a central, outwardly bowed portion 79 or 79' formed with an inwardly protruding male contact engaging boss 80 or 80'.

As shown in FIG. 1*a*–1*c* and FIG. 5, the contact locating insert 15 comprises a one-piece rectangular windowed frame 81 having top, bottom left and right members 82, 83, 84 and 85, respectively, receivable through the front of the housing cavity to form a sliding fit therein. The frame has a recessed internal rim 86 on bottom and side walls. Orthogonal wall portions 87 and 88 protrude from the top and upper portion of the right frame members 82 and 85, respectively, defining a right-angled contact locating section, and a lower portion 89 of the rim 86 on the right side is of increased width so as to support a contact separating rib 90 rib of substantially the same cross section as the contact separating post 66 and formed on a lower edge portion of the wall portion 88.

In assembling the adaptor box from the components shown in FIG. 1*a*, contacts 14, 14' are preassembled with the housing by insertion through the open front and temporarily positioned in the opening 31 in spaced apart, side by side relation, adjacent respective opposite side walls 33 with the respective feet 58 extending away from each other, located in respective notches 30, 30' on the top of the mounting head. The first female contact portion 59 is seated rests on top of post 66 with an innermost arm 78 seated in recess 67 and the rear surface of the vertical portion 77 of the strip 57 engaging housing rib 61.

Figure 4:
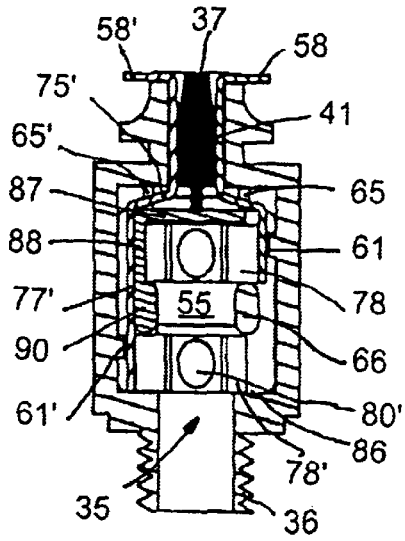
FIG. 4 is a cross-sectional view in a medial plane of the adaptor box, along line 4—4 of FIG. 1.

The second female contact portion 59' sits on the lower housing wall 17 with an innermost arm 78' seated in recess 68 and a free end thereof under post 66, and the rear surface of the vertical portion 77' of the strip engaging housing rib 61' as shown in FIG. 1*b* and FIG. 4. The contact locating insert 15 is then inserted through the front opening so that orthogonal wall portions 87 and 88 isolate the contacts from each other by extending between the transverse and vertical portions 75', 77' of contact 14' and contact arms 78 of contact 14 with the rib extending under the free end of an innermost contact arm 78 to provide vertical support and an innermost contact arm 78' to prevent it being carried upward during mating movement of a male coax connector. The rib 90 extends under both arms 78 of contact 14 and over the free ends of both arms 78' of contact 14', as shown in FIG. 1*c*. Thus, the post 66 and the rib 90 maintain the separation of the contacts 14, 14' and stabilize the contacts during insertion and removal of the coax connector from the adaptor box, and assuring axial alignment with the coax connector receiving opening 35.

The insert 13 is then assembled with the box housing 2 substantially as described in the U.S. Pat. No. 6,059,582 by inserting the lower sub frame 45, downwardly into the front opening with respective arms 43 received in the upper portions of the recess 24 and with the partitioning rib 42 received in the upper end of the passageway 31 and between the two contacts. Forceful, further insertion of the contact separating rib portion 37 axially downwards into the top of the passageway 31, causes the body portion 41 to drive the contacts further apart into engagement with respective sidewalls 33 until the ramp detents 47, 47' enter the respective locking grooves 26, 26' and lock under respective lips 27, 27' with a snap action. During insertion, the head portion 40 slides down the contact insertion slot 34 so that respective contacts are trapped between respective flanges 38, 38'; side walls 33; body portion 41 and rear wall 31' locking the insert 13 on the housing. In the fully assembled position the rebate 22 and front opening 21 of the housing are covered by the upper sub frame and hinge, and the lower sub frame and tab, respectively.

The manner of mounting and demounting the assembled adaptor box on/from the conventional low voltage track is described in the above patent.

Figure 6:
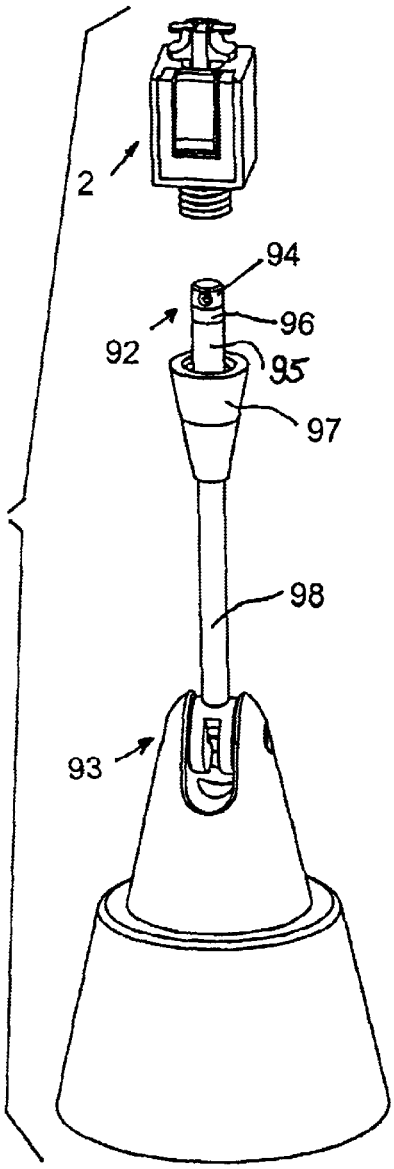
FIG. 6 is an isometric view of the adaptor box and coaxial connector on a fixture aligned for mating assemble.
Figure 5:
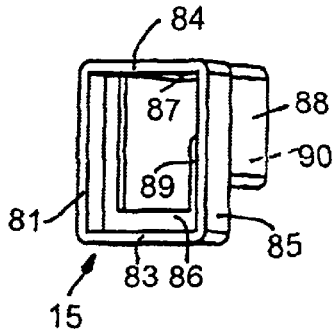
FIG. 5 is another isometric view of the contact locating insert of the adaptor box shown in FIGS. 1*a–d*.

FIG. 6 shows a male coax connector 92 of a lighting fixture 93 aligned for mating with an assembled adaptor box. The coax connector 92 has first and second cylindrical contact portions 94 and 95, respectively, electrically isolated from each other by a cylindrical insulating member 96. An internally threaded metal collar 97 mounted on a fixture stem 98 attaches to the threaded tube 36 and repeatedly turning the collar to tighten the screw progressively inserts the connector into the housing cavity with the first and second contact portions 94, 95 establishing connection with the first and second female contact portions with the first male contact portion 94 initially passing through the second female contact portion.

I claim:

1. An adaptor box for mounting a fixture to a low voltage lighting track comprising an insulating body formed by an elongate web joining flanges, having respective free ends from which mounting edge portions protrude inwards towards each other over the elongate web defining a channel section cavity for receiving a mounting head portion of the adapter box, ears located adjacent junctions of the flanges and the web and wire busses mounted on respective ears;

the adaptor box comprising:

a housing molded in one piece of insulating plastic material and comprising opposite side walls joined by upper, lower and rear walls providing a housing cavity having a front which is open, a mounting head integrally formed with the upper wall to upstand therefrom and formed with opposed mounting ears and a contact receiving through-passageway having a front, contact insertion opening, both the contact receiving through-passageway and the front, contact insertion opening extend from the housing cavity vertically through the mounting head between the mounting ears, the upper wall being formed with a recess extending from the front of the housing cavity which is open to the front, contact insertion opening so that the housing is open at a front and at a top, from the front to the front, contact insertion opening and an opening in the lower wall;

an insert molded in one piece of insulating plastic material comprising a contact separating rib and a releasable, rotation preventing latching tab portion connected together to extend in generally parallel relation, one above the other, by a transverse, resilient web hinge, a pair of one-piece contacts extending through the contact receiving through-passageway each having one end located in the housing cavity for connection to respective conductors of a fixture and another end exposed for electrical connection to respective track busses, means for attaching a low voltage lighting fixture to the housing, and the housing and the insert having resilient latching means cooperable to assemble the housing and insert together in a snap fit, the insert being assembled with the housing by insertion of the contact separating rib through the front, contact insertion opening into the through-passageway, between the contacts, with the rotation preventing latching tab portion extending across the front of the housing cavity and the transverse, resilient web hinge extending across the recess, the rotation preventing latching tab comprising an upper catch portion which, in an undeformed position of the resilient web hinge, protrudes above the upper wall of the housing in a rotation preventing position preventing rotation of the housing relative to the channel section cavity of the track when the mounting head is received therein and a lower fingerpiece, depressible to deform the resilient web hinge and withdraw the upper catch portion toward the upper wall to a release position permitting rotation of the mounting head within the channel section cavity of the track to enable removal of the adaptor box therefrom;

the improvement residing in that the one ends of the contacts comprise, respectively, a first, resilient female contact portion and a second, resilient female contact portion, means are provided in the housing cavity for locating the contacts with the first female contact portion aligned spaced apart from and above the second female contact portion to provide a common mating axis aligned with the opening in the lower wall, so that a male coax connector having a first male contact portion and a second male contact portion, located axially spaced apart from each other, adjacent and remote from a leading free end, respectively, can be inserted through the opening in the lower wall progressively into the housing cavity along the mating axis so that the first male contact portion passes through the second female contact portion and mates with the first female contact portion and the second male contact portion mates with the second female contact portion.

2. An adaptor box according to claim 1 wherein each contact is stamped and formed from a single piece of sheet metal stock and each second female contact portion is joined to the other end of a respective contact by a strip portion and comprises a pair of resilient contact arms extending transversely in opposed, spaced apart relation from the strip portion on opposite sides of the opening in the lower wall so as to embrace the male coax connector when inserted into the housing cavity.

3. An adaptor box according to claim 2 wherein the first female contact portion is joined to the other end of a respective contact by another strip portion and the first female contact portion comprises a pair of resilient contact arms extending transversely in opposed, spaced apart relation from said another strip portion so that the arms embrace the male coax connector inserted into the housing cavity, the strip portion from which the first female contact portion extends and the strip portion from which the second female contact portion extends being vertical and respectively, located adjacent respective opposite sidewalls of the housing cavity so that the resilient contact arms of the first female contact portion extend across the housing cavity in a direction opposite to a direction of extension of the resilient contact arms of the second contact portion and, the strip portion from which the first female contact portion extends being shorter than the strip portion from which the second female contact portion extends.

4. An adaptor box according to claim 3 wherein the strip portions of respective contacts are bent as they exit from the contact receiving through-passageway into the housing cavity to define divergent transverse portions extending adjacent the upper wall, respectively, away from each other towards opposite sidewalls, and above the first female contact portion, to join the respective vertical strip portions.

5. An adaptor box according to claim 4 wherein the means in the housing cavity for locating the first female contact portion aligned spaced apart from and above the second female contact portion to provide a common mating axis comprises a contact separating post protruding horizontally forward from the rear wall and laterally offset from one side of the common mating axis, to extend between respective female contacts to maintain their vertical separation and, a one-piece, insulating, contact locating insert comprising a vertical frame received through the open front into the housing cavity as a sliding fit and having a contact separating post projecting horizontally rearward and laterally offset from a side of the common mating axis opposite to the post on the rear wall of the housing cavity, to extend between respective female contacts to maintain their vertical separation.

6. An adaptor box according to claim 5 wherein the contact locating insert comprises adjoining, orthogonal wall portions extending rearward, horizontally and vertically, from upper, horizontal and vertical side members of the frame between the transverse and vertical strip portions of one contact and the resilient contact arms of the second female contact portion to maintain the contacts electrically isolated from each other.

7. An adaptor box according to claim 5 wherein the contact separating post on the insert is integrally molded as a rib with a lower edge of the vertical wall portion which extends from the vertical side member.

8. An adaptor box according to claim 1 wherein the means for attaching a low voltage lighting fixture to the housing, comprises a threaded annular lip integrally molded with the lower wall to depend from the housing around the opening.

9. An adaptor box for mounting a fixture to a low voltage lighting track comprising an insulating body formed by an elongate web joining flanges, having respective free ends from which mounting edge portions protrude inwards towards each other over the elongate web defining a channel section cavity for receiving a mounting head portion of the adapter box, ears located adjacent junctions of the flanges and the web and wire busses mounted on respective ears;

the adaptor box comprising:

an insulating housing having a cavity open at a bottom, an upstanding track mounting head formed with opposed mounting ears, a pair of one-piece contacts extending through the track mounting head into the cavity each contact having one end for connection in the cavity to a low voltage lighting fixture and another end protruding exposed from the track mounting head for electrical connection to respective track busses, and, means on the housing for attaching a low voltage lighting fixture to the housing, and the improvement residing in that the one ends of the contacts comprise, respectively, a first, resilient female contact portion and a second, resilient female contact portion, means are provided in the housing cavity for locating the contacts with the first female contact portion aligned spaced apart from and above the second female contact portion to provide a common mating axis aligned with the opening, so that a male coax connector having a first male contact portion and a second male contact portion, located axially spaced apart from each other, adjacent and remote from a leading free end, respectively, can be inserted through the opening progressively into the housing cavity along the mating axis so that the first male contact portion passes through the second female contact portion and mates with the first female contact portion and the second male contact portion mates with the second female contact portion.

10. An adaptor box comprising a housing containing an electrical contact set, the adaptor box mounts a low voltage lighting fixture to a low voltage track, the contact set comprising; a pair of one-piece stamped and formed metal pads each having a rigid elongate strip portion formed at one longitudinal end with a female contact portion and at the other end with a transverse contact foot for engagement with a respective buss of the low voltage track, the female contact portions each comprise a pair of resilient contact arms bent from opposite longitudinal edges of the strip to extend transversely from the strip in opposed, spaced apart parallel relation for embracing a male contact between them, the strip of one contact being shorter, longitudinally, than the strip of the other contact so that the contacts can be mounted in the adaptor housing with the female contact portions extending one above the other on a common vertical mating axis while the transverse contacts extend horizontally, coplanar with each other.

11. An adaptor box containing an electrical contact set, the adaptor box mounts a low voltage lighting fixture to a low voltage track, the contact set comprising a pair of one-piece stamped and formed metal pads each having a rigid elongate strip portion formed at one longitudinal end with a female contact portion and at the other end with a transverse contact foot for engagement with a respective buss of the low voltage tick, the female contact portions each comprise a pair of resilient contact arms bent from opposite longitudinal edges of the strip to extend transversely from the strip in opposed, spaced apart parallel relation for embracing a male contact between them, the strip of one contact being shorter, longitudinally, than the strip of the other contact so that the contacts can be mounted in an adaptor housing with the female contact portions extending one above the other on a common vertical mating axis while the transverse contacts extend horizontally, coplanar with each other.

* * * * *